US006213837B1

(12) United States Patent
Tolt

(10) Patent No.: US 6,213,837 B1
(45) Date of Patent: Apr. 10, 2001

(54) INHIBITING EDGE EMISSION FOR AN ADDRESSABLE FIELD EMISSION THIN FILM FLAT CATHODE DISPLAY

(75) Inventor: Zhidan Li Tolt, Austin, TX (US)

(73) Assignee: SI Diamond Technology, Inc., Austin, TX (US)

( * ) Notice: Subject to any disclaimer, the term of this patent is extended or adjusted under 35 U.S.C. 154(b) by 0 days.

(21) Appl. No.: 09/522,487

(22) Filed: Mar. 10, 2000

Related U.S. Application Data

(62) Division of application No. 09/114,721, filed on Jul. 13, 1998, now Pat. No. 6,107,732.

(51) Int. Cl.[7] ..... H01J 9/02
(52) U.S. Cl. ..... 445/24; 445/50
(58) Field of Search ..... 445/24, 58, 50

(56) References Cited

U.S. PATENT DOCUMENTS 5,552,659 * 9/1996 Macaulay ..... 313/310
5,628,659 * 5/1997 Xie et al. ..... 445/50

* cited by examiner

*Primary Examiner*—Kenneth J. Ramsey
(74) *Attorney, Agent, or Firm*—Kelly K. Kordzik; Winstead Sechrest & Minick, P.C.

(57) ABSTRACT

On a field emission cathode, emission from the edges of metal conducting feedlines is inhibited, or even eliminated, by depositing a dielectric film over the edges before deposition of the field emitter material. Surface treatment of the metal conducting feedlines or substrate may be performed to enhance the field emission properties of the field emitter at preferential locations.

9 Claims, 8 Drawing Sheets

INHIBITING EDGE EMISSION FOR AN ADDRESSABLE FIELD EMISSION THIN FILM FLAT CATHODE DISPLAY

This is a division of application Ser. No. 09/114,721 filed Jul. 13 1998, now U.S. Pat. No. 6,107,732.

TECHNICAL FIELD

The present invention relates in general to a field emission electron source, and in particular, to a field emission display.

BACKGROUND INFORMATION

Compared to a microtip field emission cathode, a thin film field emission flat cathode, such as a carbon thin film cathode, requires a simpler structure, and is easier and less expensive to manufacture. One of the challenges in producing a viable field emission flat cathode is the production of an addressable cathode because of two reasons. First, the emission properties of an emitting film often severely degrade when exposed to most processes. As a result, once the film is deposited, the cathode cannot be easily processed for patterning or other purposes. Second, there is often severe edge emission from cathode feedlines.

An addressable field emission flat cathode typically consists of metal feedlines on an insulating substrate and a field emitting film, such as an emitting carbon film, on top of the feedlines. The edges of these metal feedlines or the emitting material on these edges often emit electrons dominantly and preferentially over the desired area, such as the pixel area, because of an enhanced electrical field on these edges. As a result, the emission pattern is completely disrupted. The emission from the cathode becomes unpredictable and unstable.

Therefore, there is a need in the art for a flat field emission cathode, which has inhibited or eliminated edge emission from the metal and the emitting material located at metal feedline edges while maintaining strong emission from desired areas.

SUMMARY OF THE INVENTION

Edge emission of the metal feedlines in a thin film field emission flat cathode can be inhibited or even eliminated by covering the metal edges with a dielectric film. The emission area can be defined by removing this dielectric film only on the desired area within the two edges of the metal lines before the deposition of an emitting carbon film, using a conventional photolithography process. A surface treatment can be further applied to the area to enhance growth and emission properties of the emitting film.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
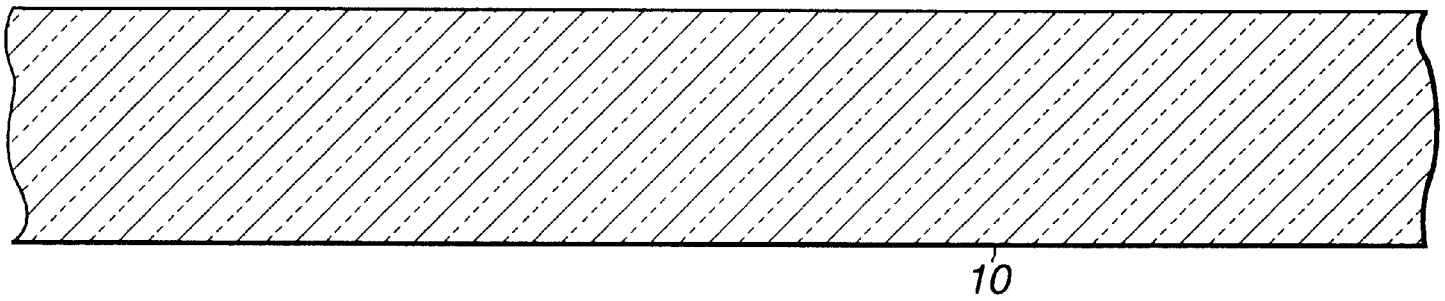
FIGS. 1–5 illustrate a process for manufacturing a flat cathode in accordance with the present invention.
Figure 12:
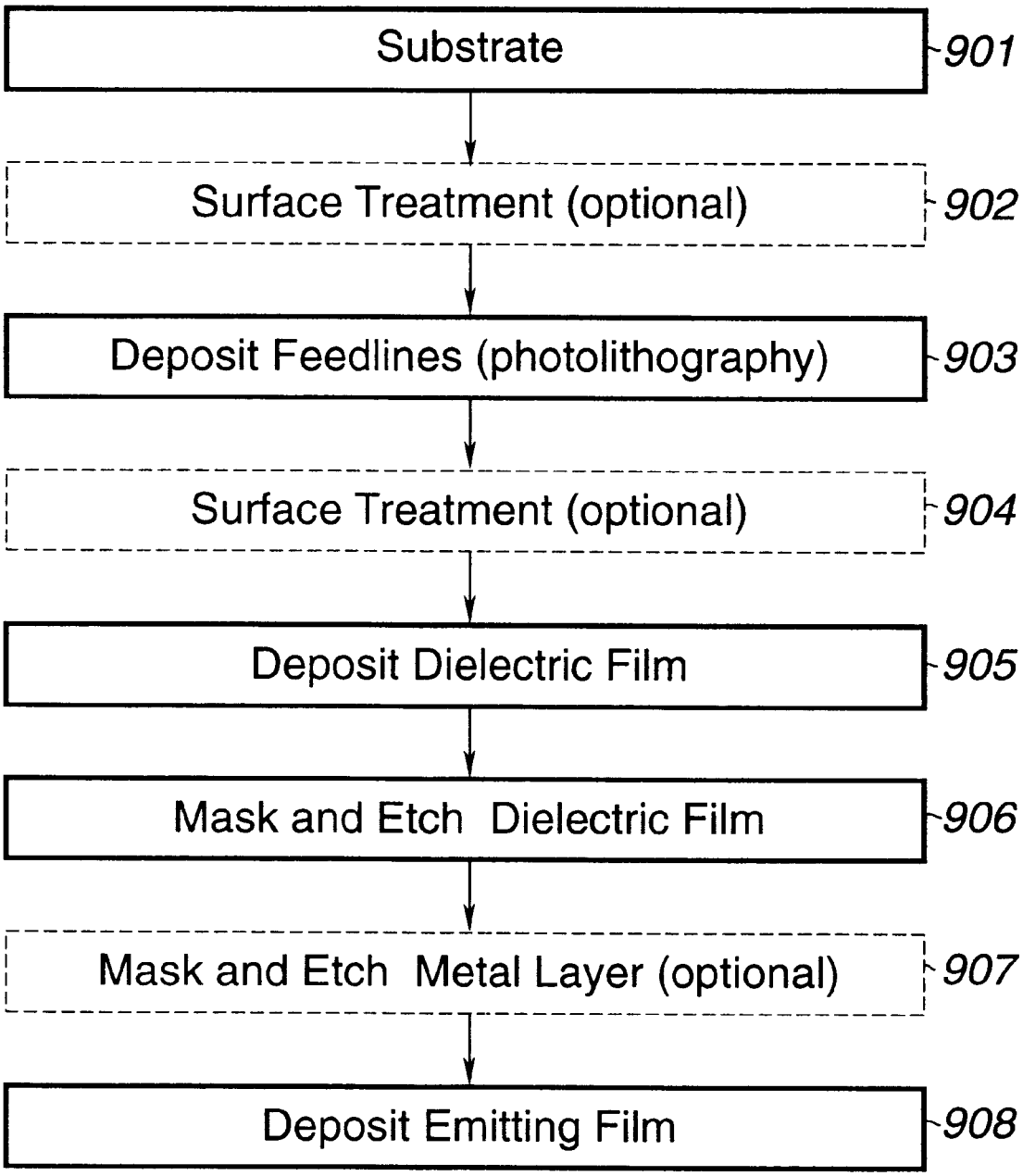
FIG. 12 illustrates a manufacturing process in accordance with the present invention.

Referring to FIGS. 1 and 12, the process begins with the provision of a substrate 10, which can be comprised of any well-known nonconducting material, such as glass (step 901).

Figure 2:
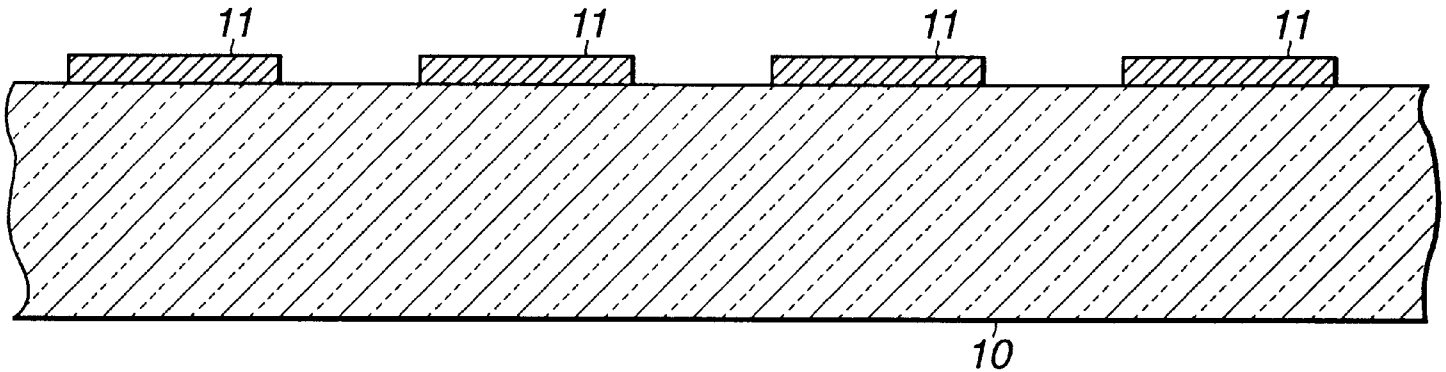

In FIG. 2, metal feedlines 11 are deposited and patterned on substrate 10 using a conventional photolithography process (step 903).

Figure 3:
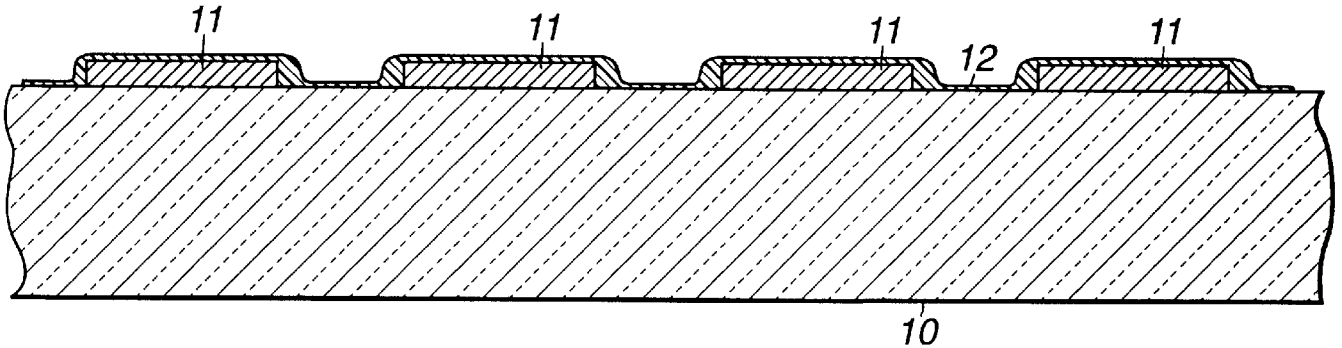

In FIG. 3, a dielectric thin film 12 is deposited over the metal feedlines 11 and substrate 10 in between the metal feedlines 11 (step 905). The dielectric thin film 12 may be less than half a micrometer. Examples of suitable dielectric films are silicon dioxide film and silicon nitrite film.

Figure 4:
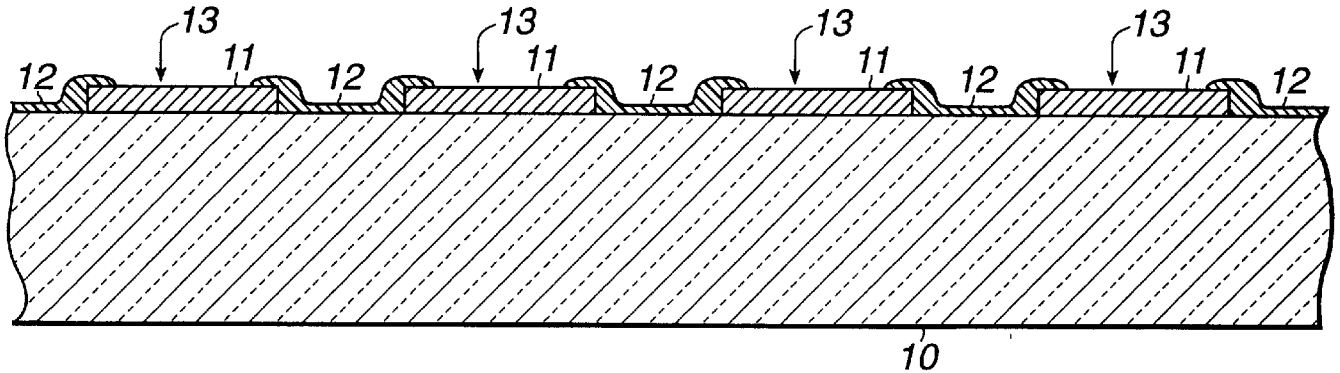
Figure 5:
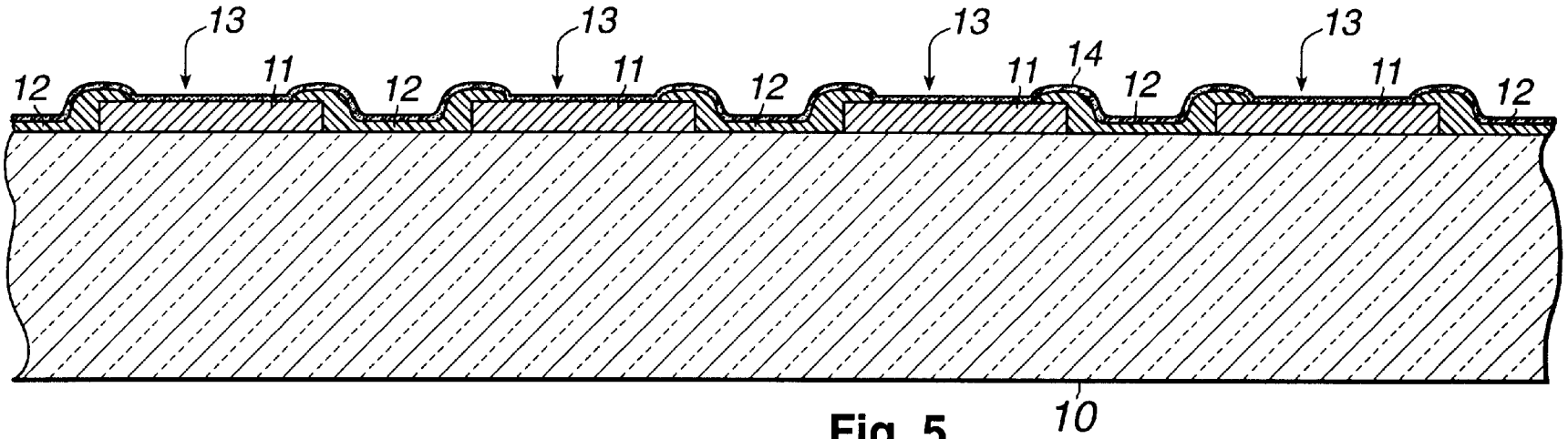
Figure 10:
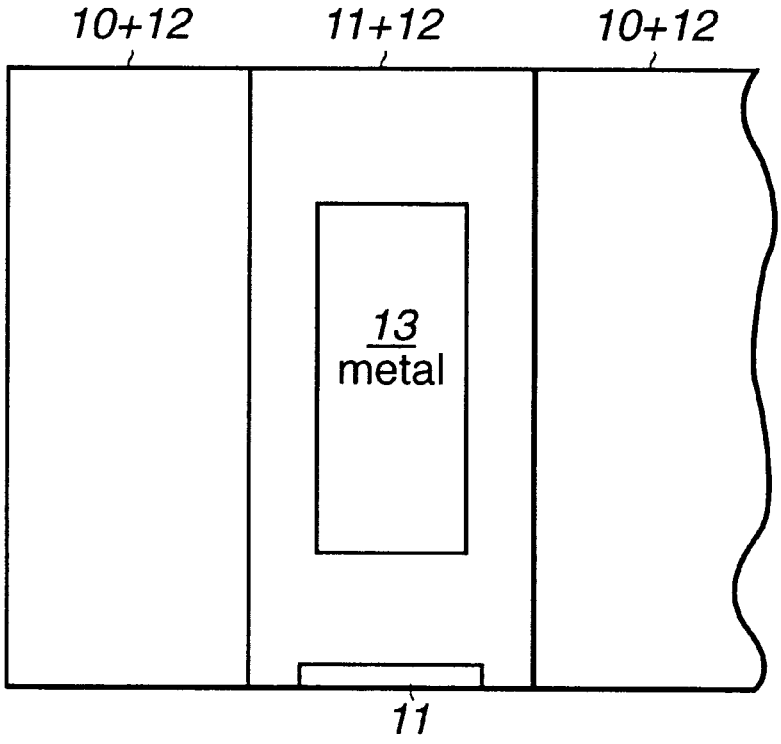
FIGS. 10 and 11 illustrate alternative embodiments of the present invention.
Figure 11:
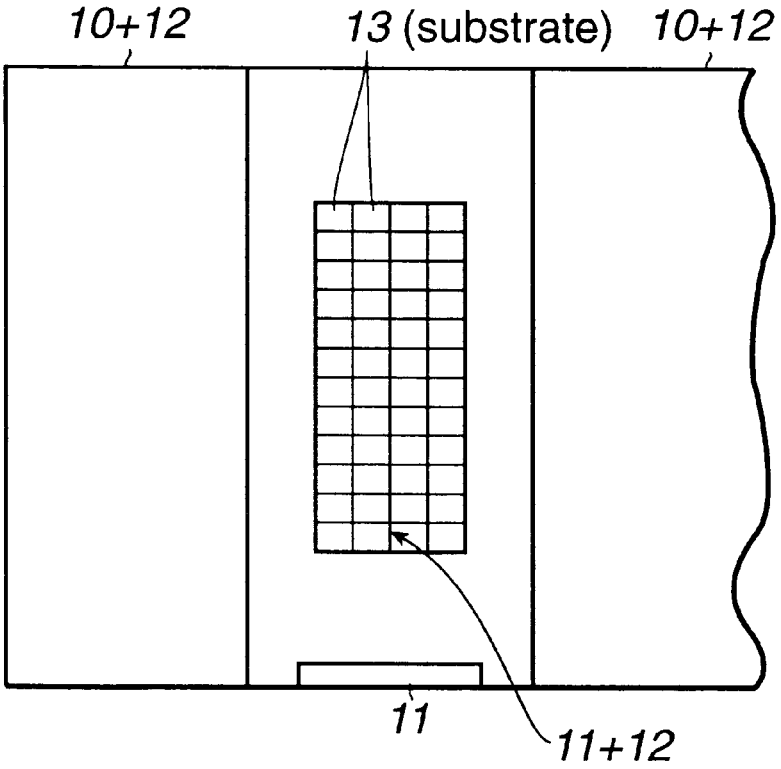

Referring to FIG. 4, a photolithography process is then used to etch away portions of the dielectric film 12 so that regions 13 on each of metal feedlines 11 are exposed (step 906). Note, however, that the edges of each of the metal feedlines 11 remain covered by dielectric film 12. Region 13 can be a continuous portion of a feedline 11, or consist of many smaller areas, each less than 1 millimeter in diameter, and the width of the dividing line less than 500 micrometers. FIGS. 10 and 11 show these two embodiments. Near the very edge of the substrate, a portion or all of the feedline will also be exposed only for the purpose of cathode electrical contact. In the case of divided region 13 (FIG. 11), the metal layer is further removed from the exposed area so that portion of the substrate is exposed (step 907).

Then, before deposition of the emitting field emission film 14, the desired emission areas 13 are activated before the deposition (step 904) or after the removal of the dielectric film 12 (step 907) by any one of treatments applied to a surface before chemical vapor deposition of diamond or diamond-like carbon films, such as sonication, mechanical vibration, or chemical etches. For example, please refer to U.S. patent application Ser. No. 08/859,960 and to U.S. patent application Ser. No. 08/859,692 for examples of such surface treatment.

In case of divided region 13, the activation is done before the deposition in step 902 or after the removal of the metal layer (step 908) in step 909.

Figure 6:
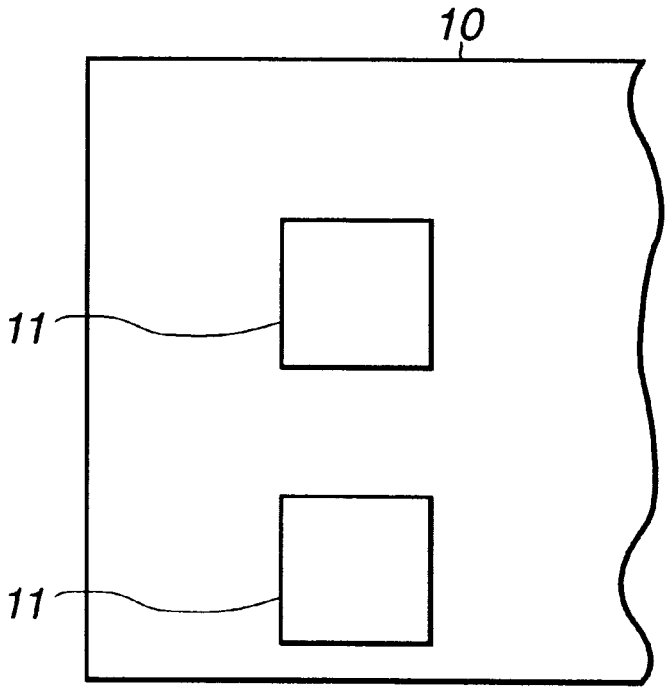
FIGS. 6 and 7 illustrate alternative embodiments for patterns for the metal feedlines.

Referring next to FIG. 6, there is illustrated a top view of one embodiment of the present invention illustrated after step 903 has been performed. In this embodiment, the metal, or conductive feedlines 11 are illustrated as isolated portions patterned on substrate 10.

Figure 7:
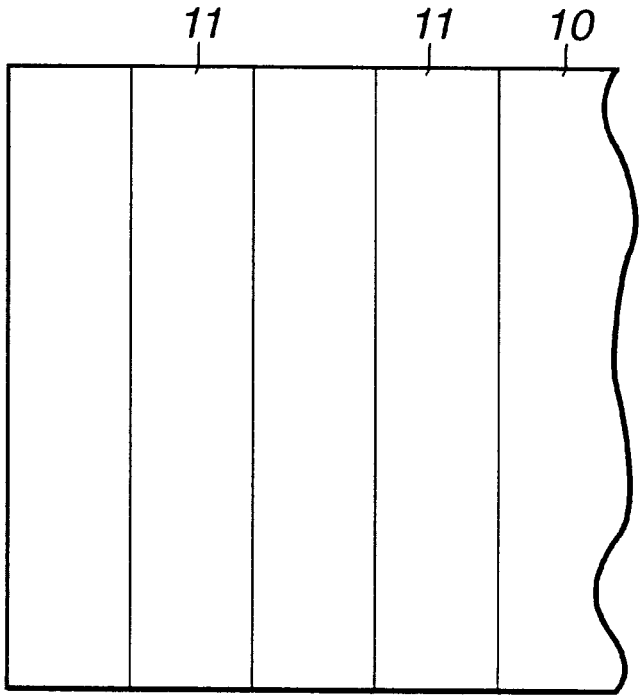

FIG. 7 illustrates another alternative embodiment of a top view of the cathode structure after step 903 has been performed. In this example, metal, or conductive, feedlines 11 are parallel strips on substrate 10.

Figure 8:
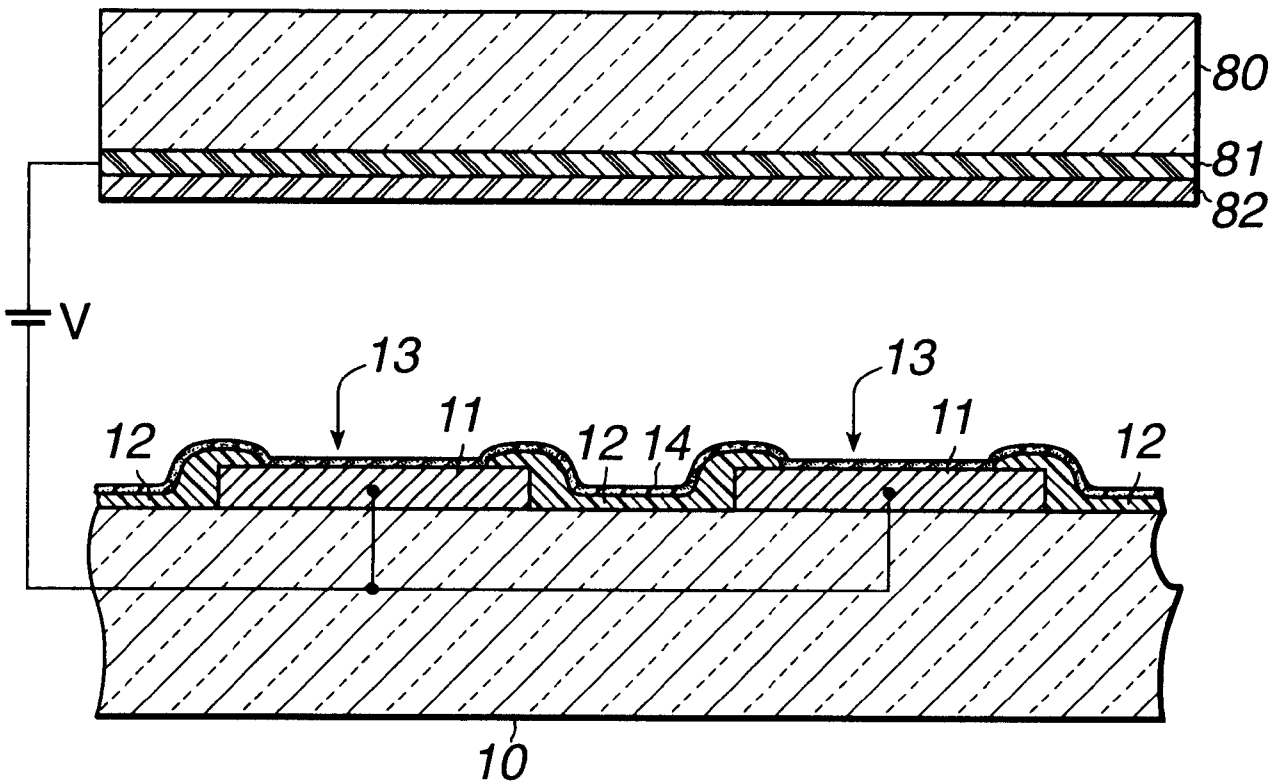
FIG. 8 illustrates a field emission display device in accordance with the present invention.

Referring next to FIG. 8, there is illustrated a portion of a display device as an example of a field emission device using the cathode structure of the present invention. An anode is positioned relative to the cathode structure. The anode may include a glass substrate 80, a conductive and transparent metal layer 81, and a phosphor layer 82 for emitting photons in response to electrons emitted from layer 14 above each of metal feedlines 11. The field emission is caused by a difference in electric potential between the anode and the cathode structures.

Spacers may be included between the anode and the cathode layers. Furthermore, an alternative construction may be utilized to implement a triode structure by placing metal gridlines across but electrically isolated from the cathode lines, between the anode structure and the cathode structure and in close proximity to the cathode structure such that these gridlines act to extract electrons from the individual cathode structures when properly biased by an electrical potential. Other metal gridlines may be added to act as focusing, deflecting, or controlling the emitted electron beam.

Figure 9:
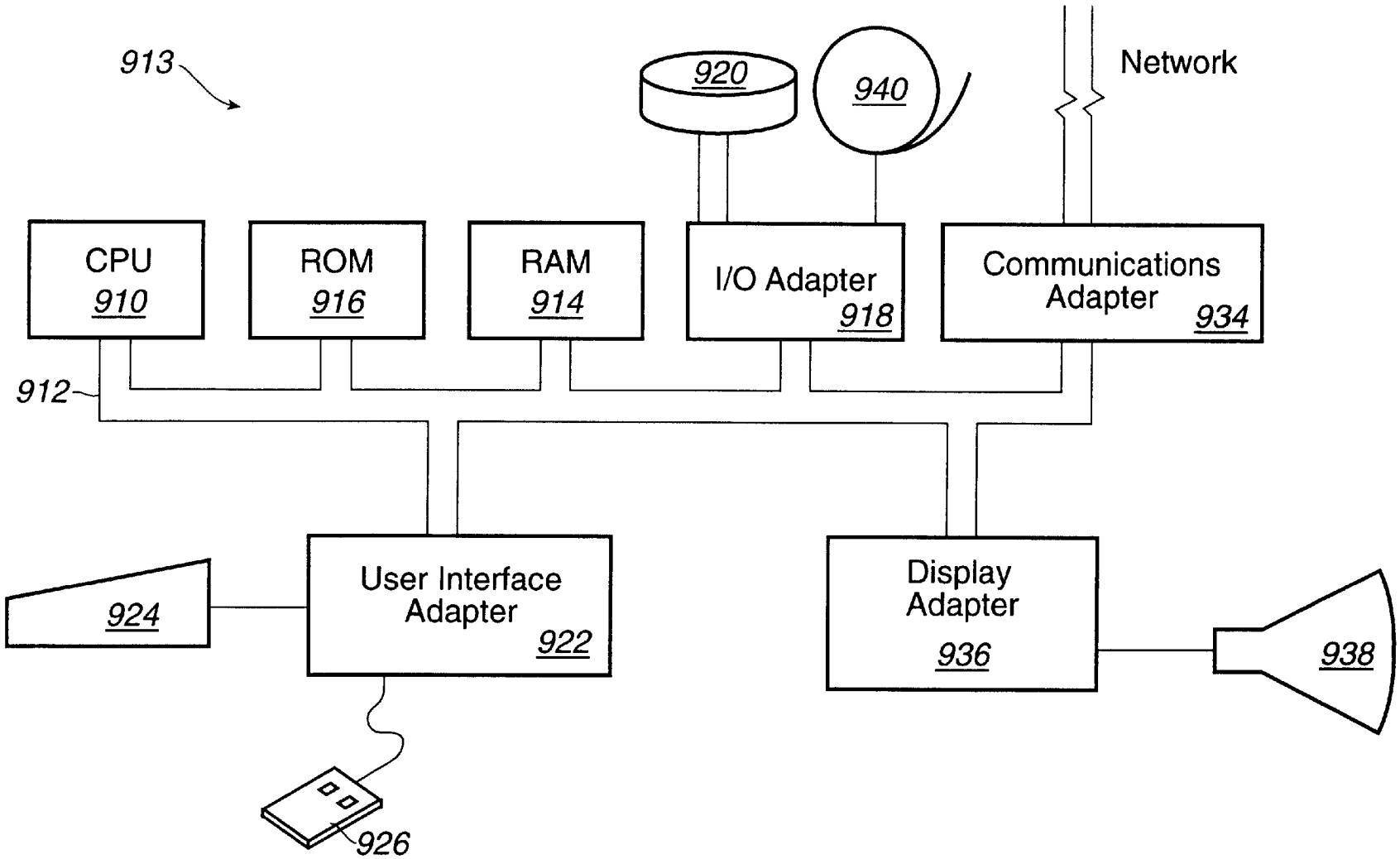
FIG. 9 illustrates a data processing system configured in accordance with the present invention.

The portion of the display device shown in FIG. 8 may be implemented within a data processing system 913 as illustrated in FIG. 9.

A representative hardware environment for practicing the present invention is depicted in FIG. 9, which illustrates a typical hardware configuration of workstation 913 in accordance with the subject invention having central processing unit (CPU) 910, such as a conventional microprocessor, and a number of other units interconnected via system bus 912. Workstation 913 includes random access memory (RAM) 914, read only memory (ROM) 916, and input/output (I/O) adapter 918 for connecting peripheral devices such as disk units 920 and tape drives 940 to bus 912, user interface adapter 922 for connecting keyboard 924, mouse 926, and/or other user interface devices such as a touch screen device (not shown) to bus 912, communication adapter 934 for connecting workstation 913 to a data processing network, and display adapter 936 for connecting bus 912 to display device 938. CPU 910 may include other circuitry not shown herein, which will include circuitry commonly found within a microprocessor, e.g., execution unit, bus interface unit, arithmetic logic unit, etc. CPU 910 may also reside on a single integrated circuit.

The result of the foregoing process is that field emission will be accomplished primarily from regions 13, and emission from the edges of metal feedlines 11 is significantly reduced, inhibited, or even eliminated.

Although the present invention and its advantages have been described in detail, it should be understood that various changes, substitutions and alterations can be made herein without departing from the spirit and scope of the invention as defined by the appended claims.

What is claimed is:

1. A method of making a field emission cathode structure comprising the steps of:

providing a substrate;

depositing a plurality of conductive strips on the substrate;

depositing a dielectric film on the conductive strips and those portions of the substrate between the plurality of conductive strips;

removing portions of the dieletric film previously deposited on the plurality of conductive strips so that the dielectric film still covers edges of the plurality of conductive strips but other portions of the plurality of conductive strips are exposed; and depositing a field emitter film on the exposed portions of the plurality of conductive strips.

2. The method as recited in claim 1, wherein the field emitter film is also deposited on the dielectric film.

3. The method as recited in claim 2, further comprising the step of treating the plurality of conductive strips before the step of depositing the dielectric film so that the field emitter film preferentially grows and emits electrons over the other portions of the plurality of conductive strips.

4. The method as recited in claim 2, further comprising the step of treating the plurality of conductive strips before the step of depositing the field emitter film so that the field emitter film preferentially grows and emits electrons over the other portions of the plurality of conductive strips.

5. The method as recited in claim 1, further comprising the step of removing the conductive strip material at a same location as the other portions to expose the substrate.

6. The method as recited in claim 5, wherein the step of removing the conductive strip material is performed before the step of depositing the field emitter film.

7. The method as recited in claim 1, further comprising the step of:

masking and etching each of the conductive strips to thereby provide a plurality of regions where the substrate is exposed through the conductive strips, wherein these regions are bounded by lines of portions of the conductive strips.

8. The method as recited in claim 7, further comprising the step of:

treating the substrate before the step of depositing the plurality of conducted strips on the substrate, so that the field emitter film preferentially grows and emits electrons over the regions of the untreated substrate.

9. The method as recited in claim 7, further comprising the step of:

treating the substrate after the step of masking and etching the metal layer so that the field emitter film preferentially grows and emits electrons over portions of the untreated substrate.

* * * * *